US006382614B1

(12) United States Patent
Fukatsu et al.

(10) Patent No.: US 6,382,614 B1
(45) Date of Patent: May 7, 2002

(54) SHEET PROCESSING APPARATUS AND IMAGE FORMING APPARATUS

(75) Inventors: Masayoshi Fukatsu, Shizuoka-ken; Teruo Komatsu, Mishima; Yasuyoshi Hayakawa, Mishima; Tsuyoshi Waragai, Mishima; Tomoyuki Araki, Numazu; Atsushi Ogata, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 19 days.

(21) Appl. No.: 09/612,289

(22) Filed: Jul. 7, 2000

(30) Foreign Application Priority Data

Jul. 9, 1999 (JP) ..... 11-195666
Jul. 30, 1999 (JP) ..... 11-216050

(51) Int. Cl.[7] ..... B42C 1/00

(52) U.S. Cl. ..... 270/58.11; 270/58.09; 270/58.12; 270/58.17; 399/410

(58) Field of Search ..... 220/58.01, 58.08, 220/58.09, 58.11, 58.12, 58.14, 58.16, 58.17; 399/403, 404, 407, 408, 410; 414/791.2, 789.8, 788.8; 271/207; 227/99

(56) References Cited

U.S. PATENT DOCUMENTS 5,288,062 A * 2/1994 Rizzolo et al. ..... 414/788.9
5,481,348 A * 1/1996 Mihara et al. ..... 271/207 X
5,592,280 A * 1/1997 Ishizuka et al. ..... 399/410
6,209,865 B1 * 4/2001 Regimbal et al. .... 414/791.2 X
6,231,039 B1 * 5/2001 Chung ..... 270/58.01
6,260,837 B1 * 7/2001 Nanba et al. ..... 270/58.08

FOREIGN PATENT DOCUMENTS

| | | | |
|---|---|---|---|
| JP | A-03-004386 | | 1/1991 |
| JP | A-05-324902 | | 12/1993 |
| JP | A-08-212298 | | 8/1996 |
| JP | 10-101262 | * | 9/1996 |
| JP | 9-226980 | * | 9/1997 |
| JP | A-11-025213 | | 1/1999 |
| JP | A-11-025217 | | 1/1999 |

* cited by examiner

*Primary Examiner*—Christopher P. Ellis
*Assistant Examiner*—Patrick Mackey
(74) *Attorney, Agent, or Firm*—Fitzpatrick, Cella, Harper & Scinto

(57) ABSTRACT

The present invention relates to a sheet processing apparatus comprising an intermediate staking portion for aligning a sheet sent, a reference wall for positioning the sheet, a stapler form performing a binding operation with respect to a sheet bundle aligned by the reference wall, delivery means for delivering the sheet bundle from the intermediate stacking portion, a sheet stacking portion for stacking the sheet bundle and guide means provided above the sheet stacking portion and at an end portion on the stapler side of the end portions in the width direction of the sheet. The guide means supports an end portion on the stapler side of the sheet bundle when the sheet bundle is delivered from the delivery means in a staple mode in which the binding operation is preformed with respect to the sheet bundled.

16 Claims, 16 Drawing Sheets

SHEET PROCESSING APPARATUS AND IMAGE FORMING APPARATUS

BACKGROUND OF THE INVENTION

1. Field of the Invention

The present invention relates to a sheet processing apparatus for selectively performing a process such as an alignment, a binding or the like with respect to sheets fed thereinto from an image forming apparatus such as a laser beam printer or the like to deliver and stack the sheets.

2. Description of the Prior Art

Conventionally, a sheet processing apparatus, mounted in an image forming apparatus such as a laser beam printer or the like, includes an intermediate stacking portion for aligning a sheet fed thereinto from the image forming apparatus, a reference wall disposed in the intermediate stacking portion for making a positioning of a widthwise direction perpendicular to a conveying direction of the sheet, a stapler, secured to a position in parallel with the reference wall, for performing binding operations with respect to an aligned sheet bundle, a delivery roller for delivering the sheet or the sheet bundle from the intermediate stacking portion, and a sheet stacking portion for stacking the sheet or the sheet bundle thus delivered, where the sheet bundle thus stapled is sequentially stacked on a stacking tray of the stacking portion by the delivery roller.

In the foregoing conventional example, the sheet bundle in a staple mode is to be delivered onto the stacking tray by the delivery roller, but such a poor stacking might occur, for example, as that a front end portion of the sheet bundle is hanging down while being delivered, and therefore the front end portion of the sheet bundle thus hanging down is caught by a staple portion of a sheet bundle already stacked on the stacking tray, thus to push out the sheet bundle.

In addition, in the foregoing conventional sheet processing apparatus, since the stapler is structured to be secured on the side of the reference wall for positioning the sheet, in the case of a plural binding operation, the sheet where a first position has been bound is designed to conveyed as a bundle to a next binding location. At this moment, the sheet bundle is to be sent by the delivery roller to the sheet stacking portion on an upstream side in a conveying direction of the sheet bundle, and in the case that the sheet bundle, the front end side of which, for example, is curved downwardly during this sending process by its own weight, is then subjected to the next binding operation, a length between staples varies between a topmost sheet and a bottommost sheet of the sheet bundle due to a difference between an outer R and an inner R, with the result that upward floating of the sheets between the staples might occur.

Furthermore, in the foregoing sheet processing apparatus, in the case of a front end-one position binding operation, as a stacking amount is increased, thus to pile up the staple portions of the sheet bundles, a portion around the staple portion at the front end of the stacked sheet bundle becomes higher. Consequently, in order to improve a stacking property of the sheet bundle as well as to increase the number of stacking sheet bundles, it is required to guide, on the upper side, the front end of the sheet bundle to be delivered, so as not to be caught by the higher portion.

SUMMARY OF THE INVENTION

It is an object of the present invention to prevent a poor stacking where a front end portion of a sheet bundle to be delivered onto a stacking tray is caught by a staple portion of a sheet bundle already stacked on the stacking tray, thus to push out the sheet bundle.

It is another object of the present invention to prevent an upward floating of sheets generated between staples of a sheet bundle which has completed a process of binding at a plurality of positions, to improve a stacking property of a sheet bundle which has completed a front-end one-position binding operation, and the like.

A representative structure of the present invention for accomplishing the foregoing objects is a sheet processing apparatus including an intermediate stacking portion for aligning a sheet fed from an image forming apparatus; a reference wall placed on one side of the sheet in a widthwise direction perpendicular to a sheet conveying direction; a stapler for performing a binding operation with respect to one side of the sheets in the widthwise direction of the sheet bundle thus aligned by the reference wall; a delivery means for delivering the sheet or the sheet bundle from the intermediate stacking portion; a sheet stacking portion for stacking the sheet or the sheet bundle delivered by the delivery means; and a guide means provided above the sheet stacking portion and at an end portion on the stapler side of the sheet end portions in the widthwise direction of the sheet, the guide means supporting the end portion on the stapler side of the sheet bundle when the sheet bundle is delivered from the delivery means in a stapler mode where the binding operation is performed with respect to the sheet bundle.

According to the above structure, when the sheet bundle is delivered from the delivery means in the staple mode, the front end of the end portion on the stapler side of the sheet bundle is supported by the guide member, so the front end of the sheet bundle is not hanging down. Accordingly, this can prevent the sheet bundle thus delivered from being caught by a staple of a sheet bundle already stacked on the stacking tray to push out the sheet bundle stacked on the stacking tray. In addition, when a plural binding operation is performed with a stapling operation, since the sheet bundle is supported by the guide means on the stapler side, an upward floating of the sheets between the staples caused by the bending of sheet bundle between the staples can be prevented.

It is to be noted that, when the delivery means makes a delivered position of the sheet or the sheet bundle different, in terms of the widthwise direction of the sheet, between in the staple mode in which the binding operation is performed with respect to the sheet bundle and in the non-staple mode in which no binding operation is carried out, the guide means is not required to support the sheet in the non-staple mode.

Further, provided that the guide means has a structure including a straight portion set to have an angle the same as a delivery angle of the sheet bundle by the delivery means, when the binding operation at the numeral positions is performed in the staple mode, an upward floating between the staples can be prevented more certainly.

In addition, provided that the guide means has a structure having an R-shaped portion which is connected from the straight portion and is curving upwardly, the front end of the sheet bundle and the staple of the sheet bundle stacked on the sheet stacking portion can be prevented, more certainly, from interfering with each other. Furthermore, provided that the R-shaped portion has a slope inclining downwardly toward the other side of the sheet the sheet bundle can drop down more smoothly onto the sheet stacking portion.

Moreover, provided that the sheet stacking portion has a structure having a front-end fully-loaded detection means for detecting a fully-loaded state of the front ends of the sheet bundles and a rear-end fully-loaded detection means for detecting a fully-loaded state at the rear end of the sheet bundle, the fully-loaded state of the sheet bundles can be accurately traced if the sheet bundles are stacked and increased in bulk due to the staples.

Also, provided that the rear-end fully-loaded detection means has a structure detecting stacking heights in the staple mode in which the binding operation is performed with respect to the sheet bundle and in the non-staple mode in which no binding operation is performed with respect to the sheet bundle, independent maximum stacking conditions of the stapling state and non-stapling state can be changed respectively. More specifically, the rear-end fully-loaded detection means is realized as a contact sensor having a lower first detecting position in contact with the sheet bundle in the staple mode and a higher second detecting portion in contact with the sheet in non-staple mode.

Further, provided that a pushing means is provided in a portion on a top surface side of the guide means or the guide means is designed to move forward and backward on its own, leaning of the sheet bundles on the guide means can be eliminated, thus to be able to increase the number of stacking bundles on the sheet stacking portion.

It is to be noted that the sheet processing apparatus together with an image forming means for forming images on sheets as well as a conveying means for conveying the sheet where the image is formed may constitute an image forming apparatus.

BRIEF DESCRIPTION OF THE DRAWINGS

The above and other objects and features of the invention are apparent to those skilled in the art from the following referred embodiments thereof when considered in conjunction with the accompanied drawings, in which.

Figure 1:
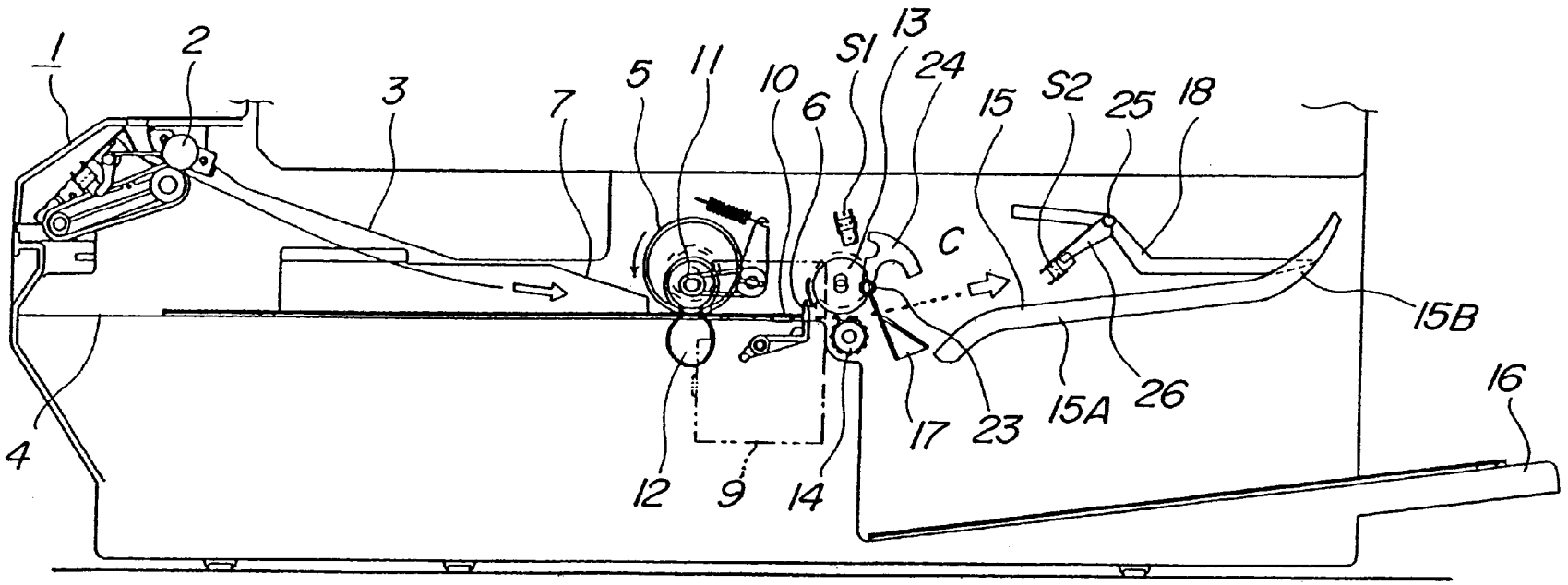
FIG. 1 is a typical cross section showing a schematic structure of a sheet processing apparatus having a sheet guide means according to a first embodiment.

Referring to the drawings, one embodiment of a sheet processing apparatus to which the present invention is applied will be specifically described hereinafter. It is to be noted that a sheet processing apparatus used in an image forming apparatus will be exemplified in the following description.

First embodiment

Figure 2:
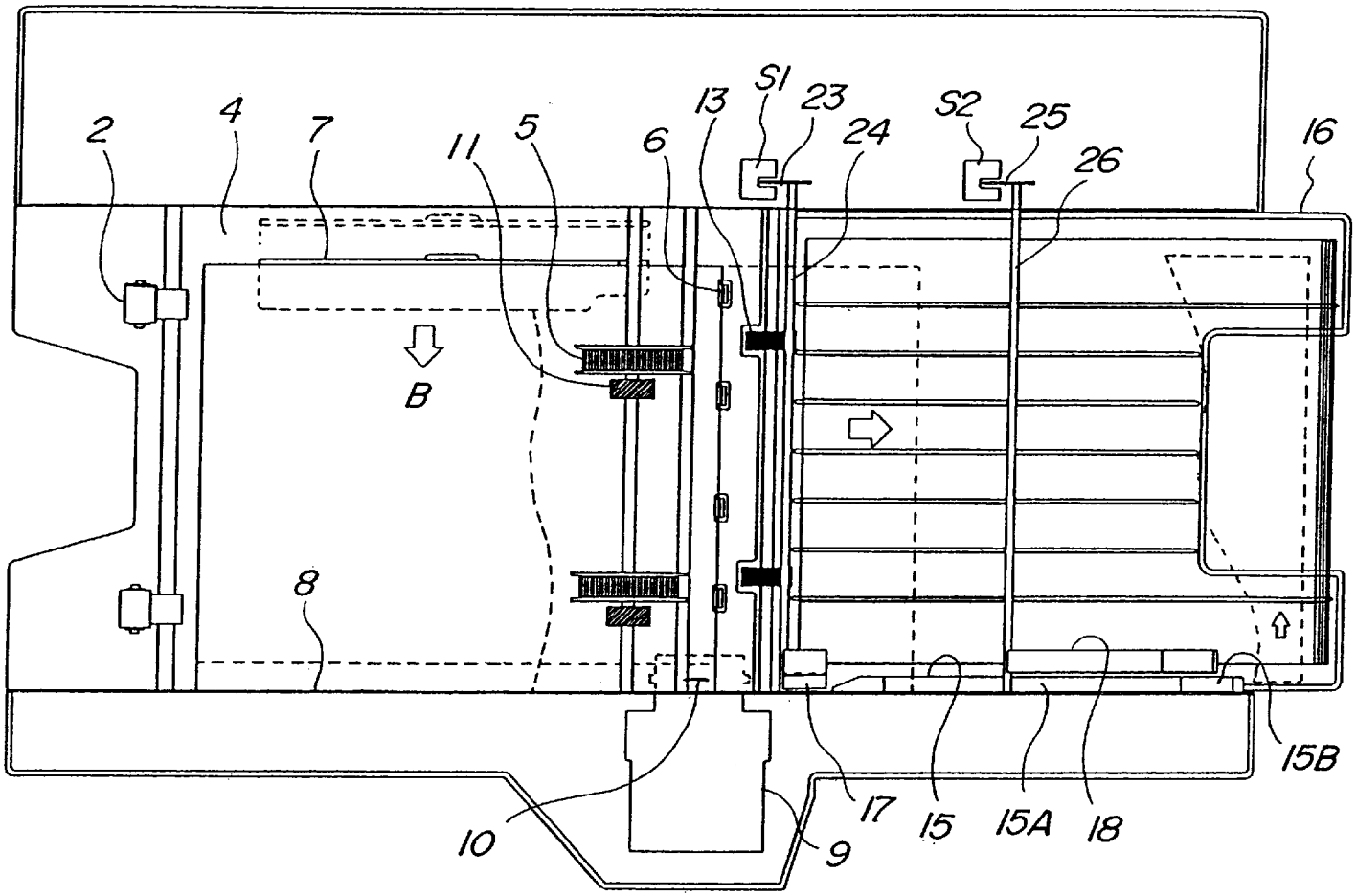
FIG. 2 is a structural view seen from a top surface of the sheet processing apparatus.

A sheet processing apparatus according to a first embodiment will be described in detail, based on the drawings. FIG. 1 is a typical cross section showing a schematic structure of the sheet processing apparatus having a sheet guide means, and FIG. 2 is a structural view seen from a top surface of the sheet processing apparatus.

A sheet processing apparatus 1 has a staple mode in which sheets are stapled and the resulting sheet bundles are stacked as well as a non-staple mode in which sheets are stacked without being stapled.

First, the staple mode will be explained.

After conveyed by an alignment delivery roller 2 to the sheet processing apparatus 1, the sheet is introduced by an upper guide 3 to an approximately center in a sheet widthwise direction (a direction perpendicular to a conveying direction) on a sheet alignment portion 4 (alignment table), and is drawn by a longitudinal alignment belt 5 so that an front end of the sheet is hit with a shutter 6.

It is to be noted that, although the longitudinal alignment belt 5 keeps rotating in a direction of drawing the sheet after the sheet front end hits the shutter 6, the conveying force is set weak so that the sheet does not buckle or the sheet does not push the shutter 6 to be open.

By determining a timing at which a rear end of the sheet passes through the alignment delivery roller 2 and the front end hits the shutter 6, a lateral registration alignment plate 7 is pushed into an arrow B direction in FIG. 2, with the result that alignment in a lateral direction (widthwise direction) is conducted as the sheet is being pressed to a reference wall 8. At this time, the lateral registration alignment plate 7 is controlled so as to be pushed into a position which is slightly narrower than the sheet width. Further, the lateral registration alignment plate 7 is provided with a space for play in a direction of narrowing the width of the sheet by a spring member (not shown). Since the space for play is set to be wider than the amount to which the lateral registration alignment plate 7 pushes narrowly from the sheet width, when a reactive force of the sheet exceeds a predetermined amount, the lateral registration alignment plate 7 is incapable of resisting the reactive force of the sheet thus pushed in, to remain in the width of the sheet within the space for play.

After aligned as mentioned above, a sheet bundle of a predetermined number of the sheets aligned in the alignment portion moves to a step of stapling by a stapler unit 9.

The stapler unit 9 is secured to a right upper portion in the conveying direction (on a downstream side in the conveying direction on the side of the reference wall 8) with respect to the sheet. Consequently, in the case of one-position binding operation, the sheet bundle can be bound at a corner-binding position 10, in a place where the lateral registration alignment plate 7 has been pushed into the sheet width position.

First, in a state where the sheet bundle is maintained at the alignment location, a bundle conveying roller 11 moves down to nip the sheet bundle with a backup roller 12. Then, in a state where the sheet bundle is retained while the bundle conveying roller 11 is stopped, the stapler unit 9 performs a stapling operation. Thereafter, the shutter 6 is opened, and at the same time, the bundle conveying roller 11 is driven to start delivering the sheet bundle. At this moment, a delivery roller 13 waiting above starts moving down to nip the sheet bundle with a backup roller 14 after the sheet bundle passes below the delivery roller 13. At this time, the delivery roller 13 is continually driven and is not released from being driven even after moving downwardly. As a result, the sheet bundle is conveyed by the both rollers, and as indicated by a dotted line C in FIG. 1, the sheet bundle is moved along a guide means 15 to be delivered and stacked on a sheet stacking tray 16. Incidentally, at this moment, the lateral registration alignment plate 7 is maintained in a state of pushing the sheet bundle into the reference wall 8.

Next, in the case of a two-position binding operation where a first stapling position is not at the corner of the sheet bundle but the stapling operation is carried out with respect to a position at a predetermined distance from a center of the length in a sheet conveying direction, the sheet bundle is required to be conveyed to the stapling location for stapling the first position.

First, in a state where the sheet is maintained at the alignment position, the bundle conveying roller 11 moves down to nip the sheet bundle with the backup roller 12. Then, the shutter 6 is opened, and at the same time, the bundle conveying roller 11 is driven to start conveying the sheet bundle. After the bundle is conveyed, as a bundle, to the stapling location for the first position, the stapling operation for the first position is performed by the stapler unit 9 in a state where the sheet bundle is retained while the bundle conveying roller 11 is stopped. At the same time when driving the bundle conveying roller 11 is resumed, the delivery roller 13 waiting above starts moving down to nip the sheet bundle with the backup roller 14. Since the delivery roller 13 continuously rotates, the sheet bundle is conveyed, as a bundle, to the stapling location for the second position with both of the rollers. Then, after the sheet bundle is conveyed, as a bundle, to the stapling location for the second position, the second stapling operation is performed by the stapler unit 9 in a state where the sheet bundle is retained while both the rollers stop rotating. Thereafter, driving both of the rollers is resumed, and the sheet bundle is moved along the guide means 15 to be delivered and stacked on the sheet stacking tray 16.

Figure 3:
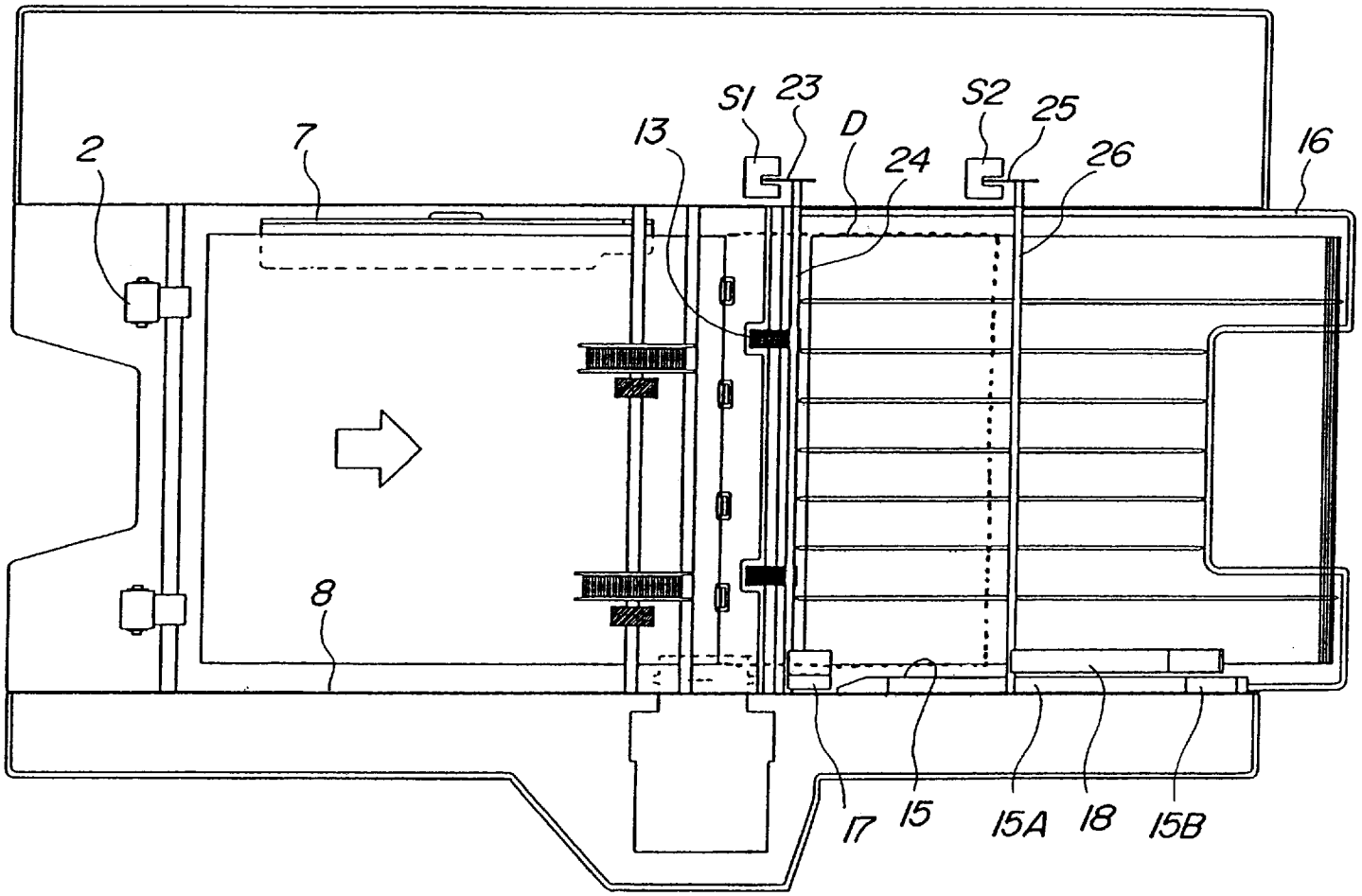
FIG. 3 is a structural view seen from a top surface of the sheet processing apparatus.

Next, a non-staple mode in which sheets are stacked without being aligned will be described. FIG. 3 is a structural view seen from the top surface of the sheet processing apparatus.

In the non-staple mode, the bundle conveying roller 11 and the delivery roller 13 are continuously driven to rotate while continuously staying down to nip with the backup rollers 12, 14 respectively. The shutter 6 is normally opened. Thus, the sheet, after introduced to an approximately center of the sheet alignment portion 4 by the alignment delivery roller 2, is then nipped between the bundle conveying roller 11 and the delivery roller 13 as it is, and as indicated by a dotted line D in FIG. 3, the sheet is delivered and stacked at an approximately center on the stacking tray 16 without moving along the guide means 15.

Here, the guide means 15 in the stacking portion according to the present invention will be described.

Figure 4:
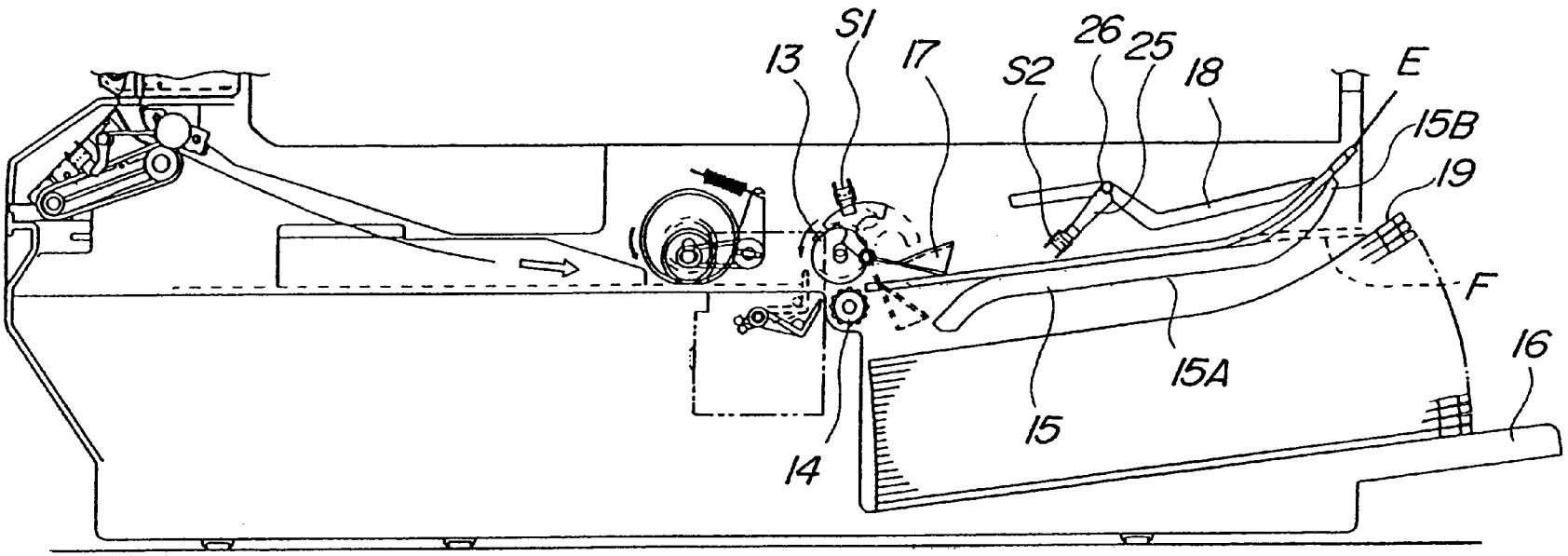
FIG. 4 is a typical cross section showing a sheet stacking portion in a staple mode of a one-position binding operation of the sheet processing apparatus.

FIG. 4 is a typical cross section showing the sheet stacking portion in the staple mode of a one-position binding operation of the sheet processing apparatus. Numeral 17 is a front-end fully-loaded detection flag as a front-end fully-loaded detection means, and numeral 18 is a rear-end fully-loaded detection flag as a rear-end fully-loaded detection means.

After delivered along the guide means 15 formed on the reference wall 8 in the stacking portion on the downstream side of the delivery roller 13, a sheet bundle E is stacked on the stacking tray 16 (or on the sheet bundle stacked on the stacking tray 16). As the number of stacking bundles increases, the front end portion of the sheet bundle is stacked in a manner of being higher due to the piling up of the staple portion 19 at the corner of the front end of the sheet bundle. Without the guide means 15 for maintaining the delivery angle of the sheet bundle, a front end of the following sheet bundle is delivered in a manner of hanging down as indicated by a dotted line F in FIG. 4. In this case, there might occur the poor stacking where the front end of the sheet bundle which is sequentially delivered (dotted line F in FIG. 4) is caught by the staple portion 19 of the sheet bundle stacked on the stacking tray 16, thus to push out the sheet bundle.

Figure 5:
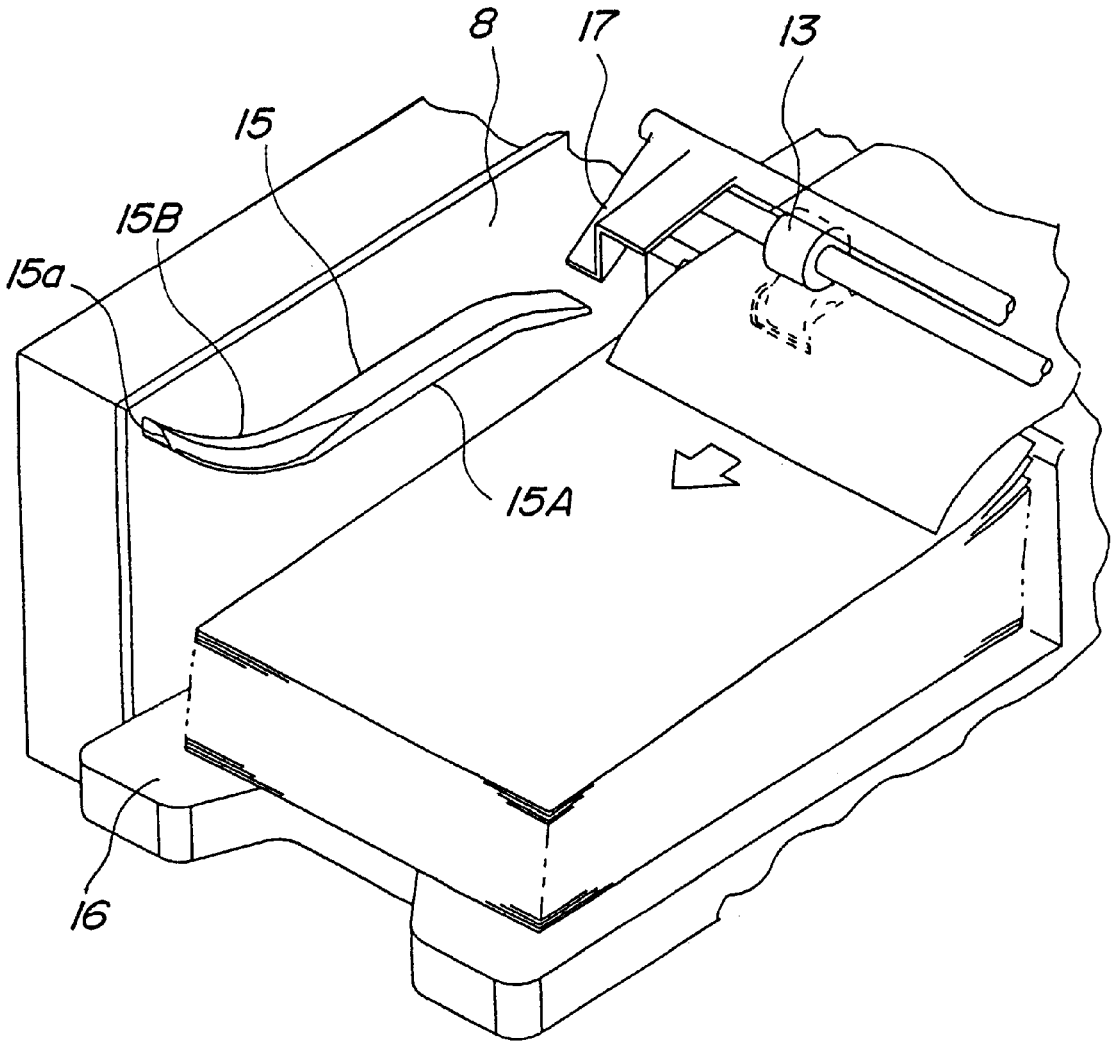
FIG. 5 is a typical perspective view showing a shape of the guide means at the sheet stacking portion of the sheet processing apparatus.

Therefore, the guide means 15 has a front end (the end portion on the downstream side in the conveying direction) curving upwardly to form an R-shaped portion 15B where the front end of the sheet bundle E thus delivered along the guide means 15 is to be once lifted and thereafter to be dropped onto the stacking tray 16 so as to carry out the stacking operation. It is to be noted that the R-shaped portion of the guide means 15 has a slope 115*a* on the stacking tray side, as shown in FIG. 5, for smoothly dropping the sheet bundle E thus guided onto the stacking portion (the stacking tray 16).

Figure 6:
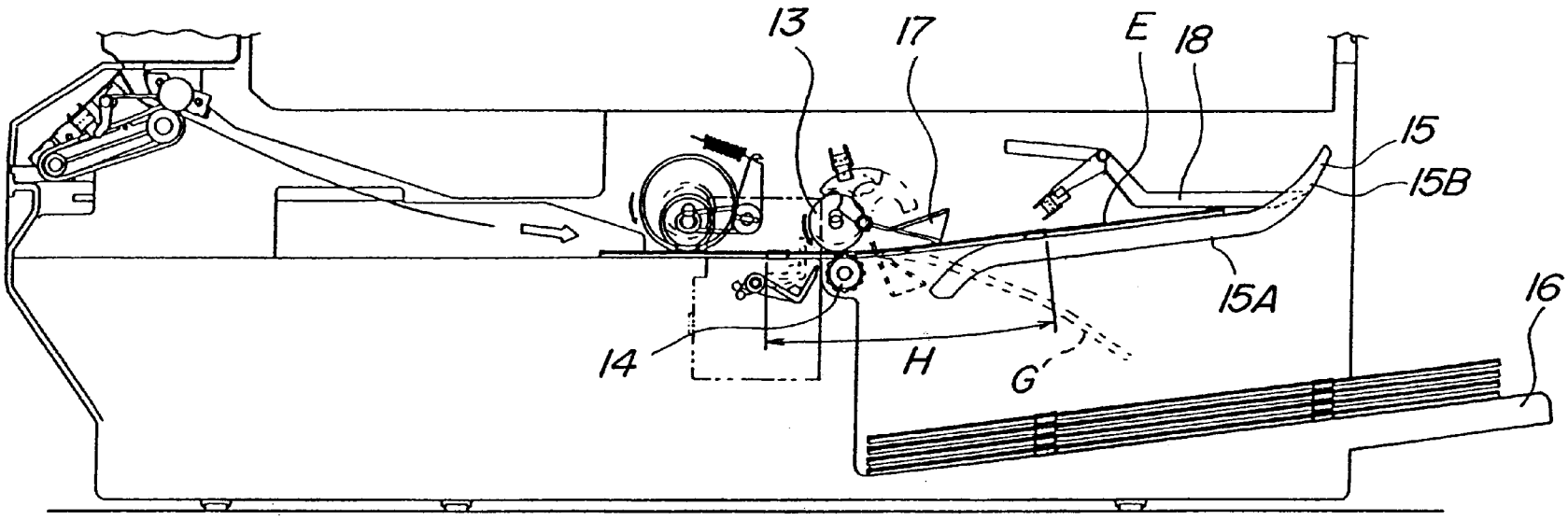
FIG. 6 is a typical cross section showing the sheet stacking portion in a staple mode of a two-position binding operation of the sheet processing apparatus.

FIG. 6 is a typical cross section showing the sheet stacking portion in a staple mode of a two-position binding operation of the sheet processing apparatus.

Figure 7:
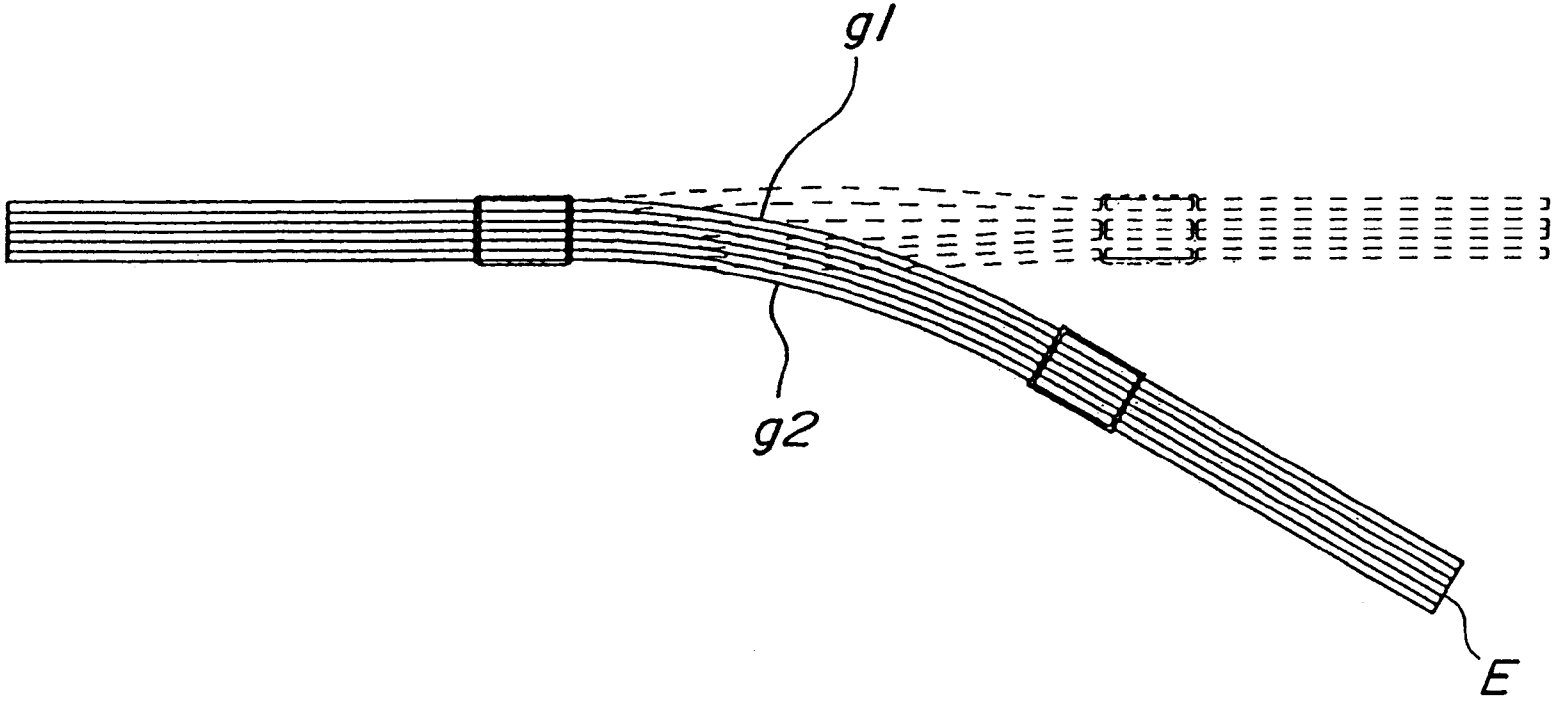
FIG. 7 is a view showing a curving state of the sheets generated between staples in the sheet bundle at the time of carrying out the two-position binding operation.

In the staple mode of the two-position binding operation, the sheet bundle E where the first position has been bound is then conveyed, as a bundle, to the binding location for the second position as mentioned above, and is once stopped. Then, the stapling operation for the second position is to start, but, without the guide means 15 for maintaining the delivery angle of the sheet bundle, the front end of the following sheet bundle is delivered in a manner of hanging down as indicated by a dotted line G in FIG. 6. When the sheet bundle in such a curving state is subjected to the stapling operation for the second position, as for an arc length g1 between staples of a topmost sheet of the sheet bundle and an arc length g2 between staples of a bottommost sheet of the sheet bundle as shown in FIG. 7, each of the lengths between the staples has changed due to a difference between an outer R and an inner R, and therefore an upward floating of the sheet occurs between the staples in the sheet bundle which completes the stapling operation.

Thus, in the guide means 15, the straight portion 15A keeps the portion approximately straight, as indicated by H in FIG. 6, between the staples of the sheet bundle E until the time that the delivered sheet bundle E is stopped at a final stapling location. Thus, no upward floating occurs between the staples of the sheet bundle E. It is to be noted that, since there is provided the R-shaped portion 15B connecting to the straight portion of the guide means 15 and curving upwardly, in the case of processing the sheet bundle in the front-end one-position binding mode, it is difficult for the R-shaped portion 15B to interfere with the front end of the bundle, if the front end of the bundle becomes higher.

Next, the fully-loaded detection means for detecting a fully-loaded condition in the stacking portion will be described.

Figure 8:
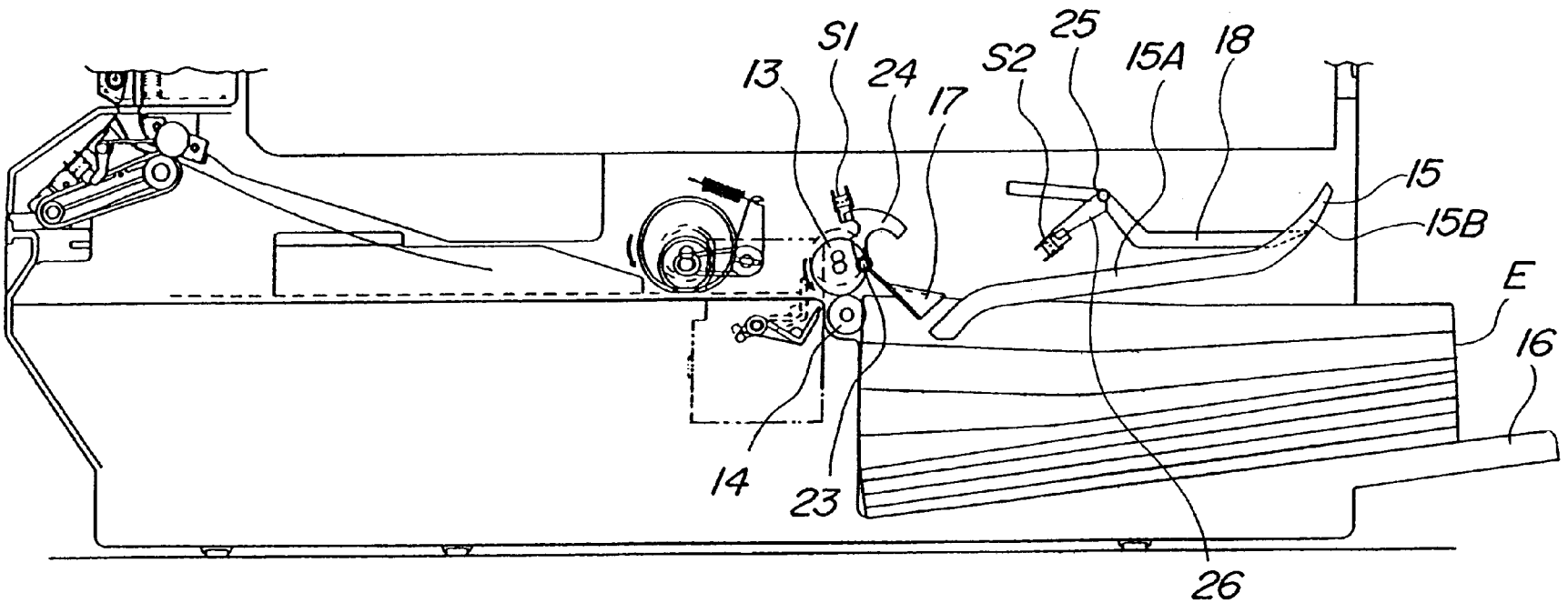
FIG. 8 is a typical cross section showing a fully-loaded detection means in the sheet stacking portion of the sheet processing apparatus.

As for the fully-loaded detection in the stacking portion, as shown in FIG. 8, different heights of the sheet bundles stacked on the stacking tray 16 are detected respectively by a rear-end fully-loaded detection flag 17 disposed on the rear end side of the sheet bundle (on the upstream side in the conveying direction) and a front-end fully-loaded detection flag 18 disposed on the front end side of the sheet bundle (on the downstream side in the conveying direction).

First the front-end fully-loaded detection flag 18, a contact type sensor, is disposed in a vicinity of the R-shaped portion 15B on the front end side of the guide means 15 (on the downstream side in the sheet conveying direction), for detecting, by contacting with a sheet bundle, that the sheet bundles exceed a predetermined stacking height. Therefore, a fully-loaded condition can be detected before a height in a vicinity of the staple of the one-position bound sheet bundle stacked along the guide means 15 exceeds a height position of the guide means 15. More specifically, when contacted with the sheet bundle, the front-end fully-loaded detection flag 18 starts rotating to rotate, through a rotary rod 25, an arm 26 formed at the other end of the rotary rod, and then the arm 26 becomes in a state of being continuously undetectable from a sensor 52, with the result that a fully-loaded state of the sheet bundles on the front end side of the stacking tray 16 can be checked.

Figure 9:
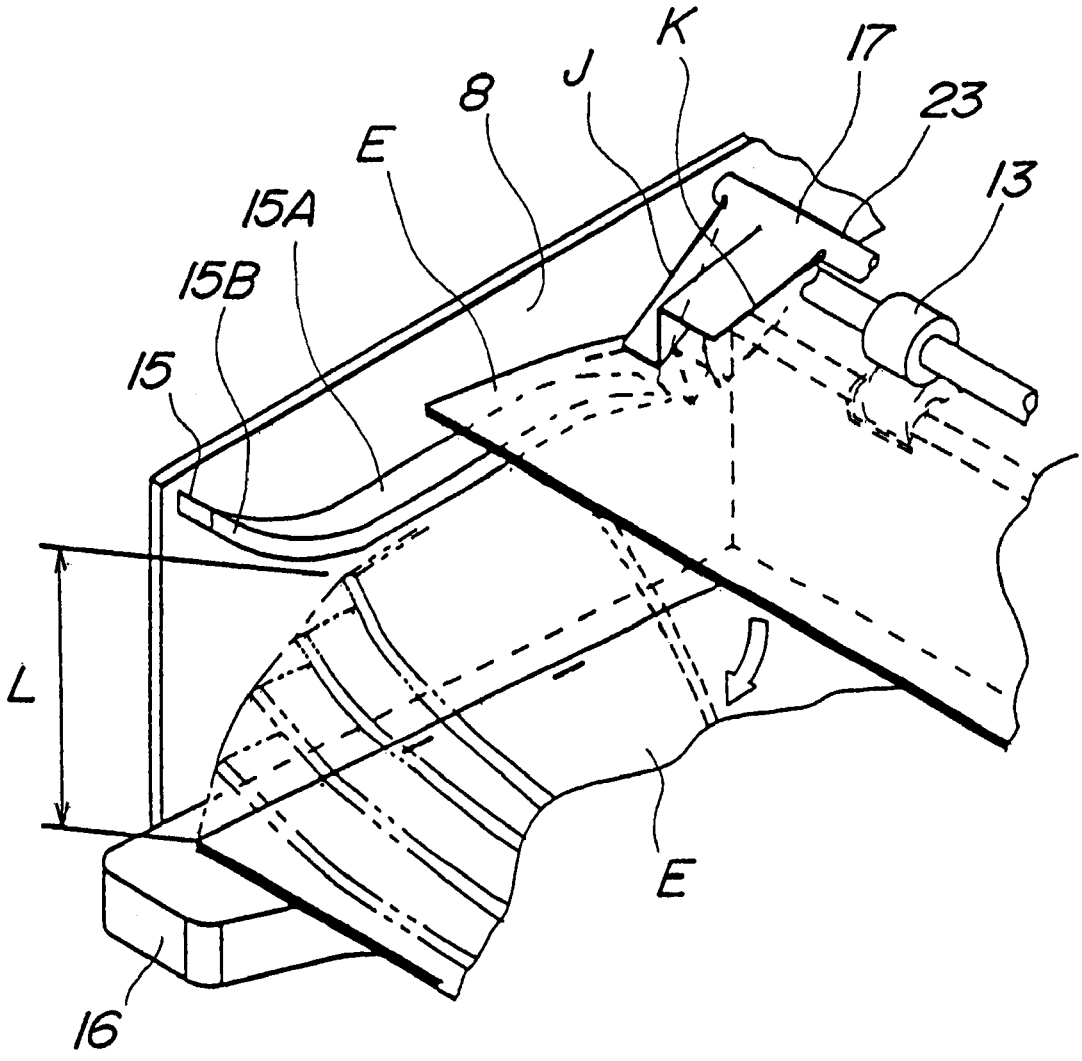
FIG. 9 is a typical perspective view showing a state of the fully-loaded detection means in the sheet stacking portion of the sheet processing apparatus.

On the other hand, the rear-end fully-loaded detection flag 17, a contact sensor as well, is disposed in a vicinity of an end portion on the rear end side (on an upstream side in the sheet conveying direction) of the guide means 15, having a shape capable of detecting the different two heights as shown in FIG. 9, resulting in that detecting the fully-loaded condition on the stacking tray 16 can be performed at different positions. More specifically, when contacted with the sheet bundle, the rear-end fully-loaded detection flag 17 starts rotating to rotate, through a rotary rod 23, an arm 24 formed at the other end of the rotary rod, and then the arm 24 becomes in a state of being continuously detectable from a sensor 51, with the result that a fully-loaded state of the sheet bundles on the rear end side of the stacking tray 16 can be checked.

First, a first detecting position J disposed so as to detect a presence or absence of the sheet bundle in a vicinity of the rear end of the guide means 15 is to detect a fully-loaded condition before the sheet bundle exceeds the height of the rear end of the guide means 15.

Figure 10:
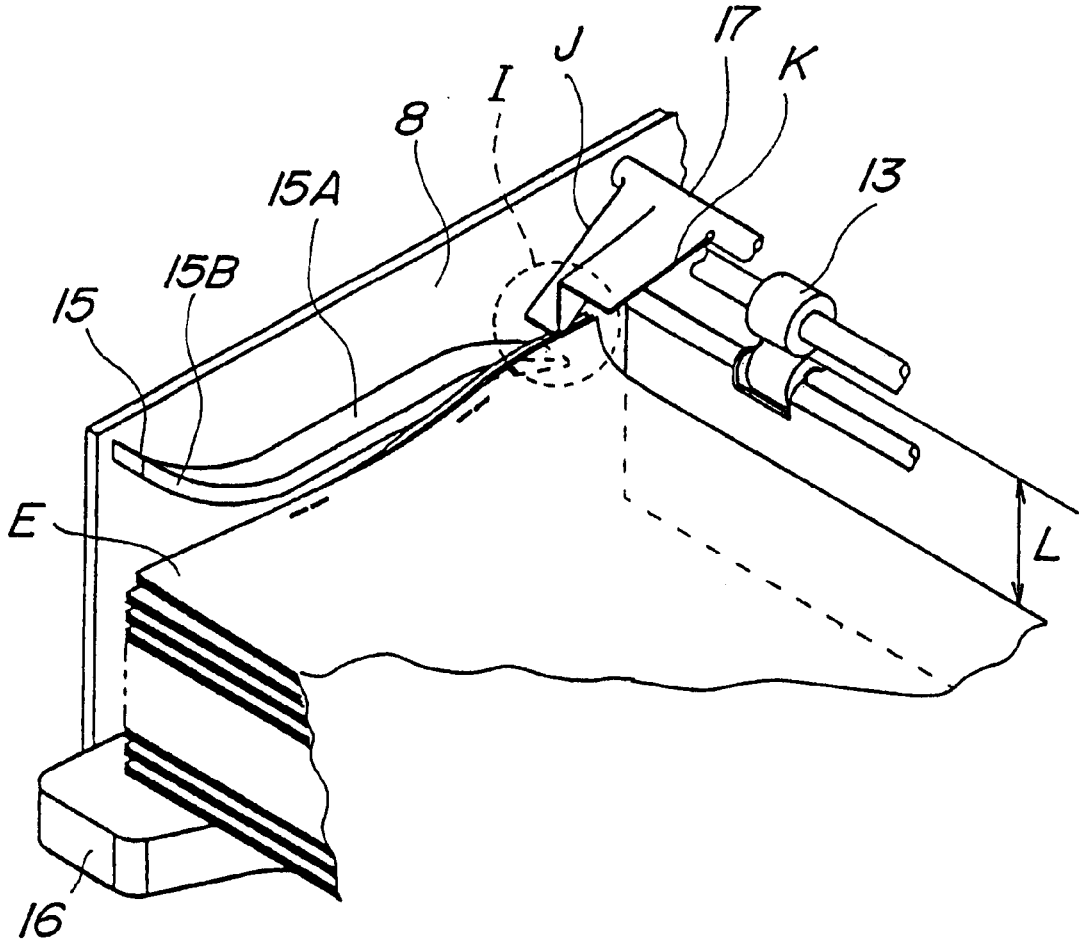
FIG. 10 is a typical perspective view showing a state of the fully-loaded detection means in the sheet stacking portion of the sheet processing apparatus.

In the staple mode, after the rear end of the sheet bundle E passes through the delivery roller 13, the sheet bundle E delivered along the guide means 15 gradually slips from the guide means 15 due to a drop L between the guide means 15 and the stacking tray 16 as well as an elasticity of the sheet bundle E, thus to fall onto the stacking tray 16. As shown in FIG. 10, as a sheet stacking amount increases, the drop L between the guide means 15 and a topmost surface of the stacked sheet bundle becomes smaller, where the rear-end fully-loaded detection flag 17 detects that the rear end of the sheet bundle E is still in a state of leaning on an I portion of the rear end of the guide means 15 after passing through the delivery roller 13, thus to judge the fully-loaded detection.

Next, a second detecting position K disposed higher than and slightly nearer the center in the sheet width direction than the first detecting position J is to detect a stacking height of the sheet bundles (or sheets) in the non-staple mode.

Figure 11:
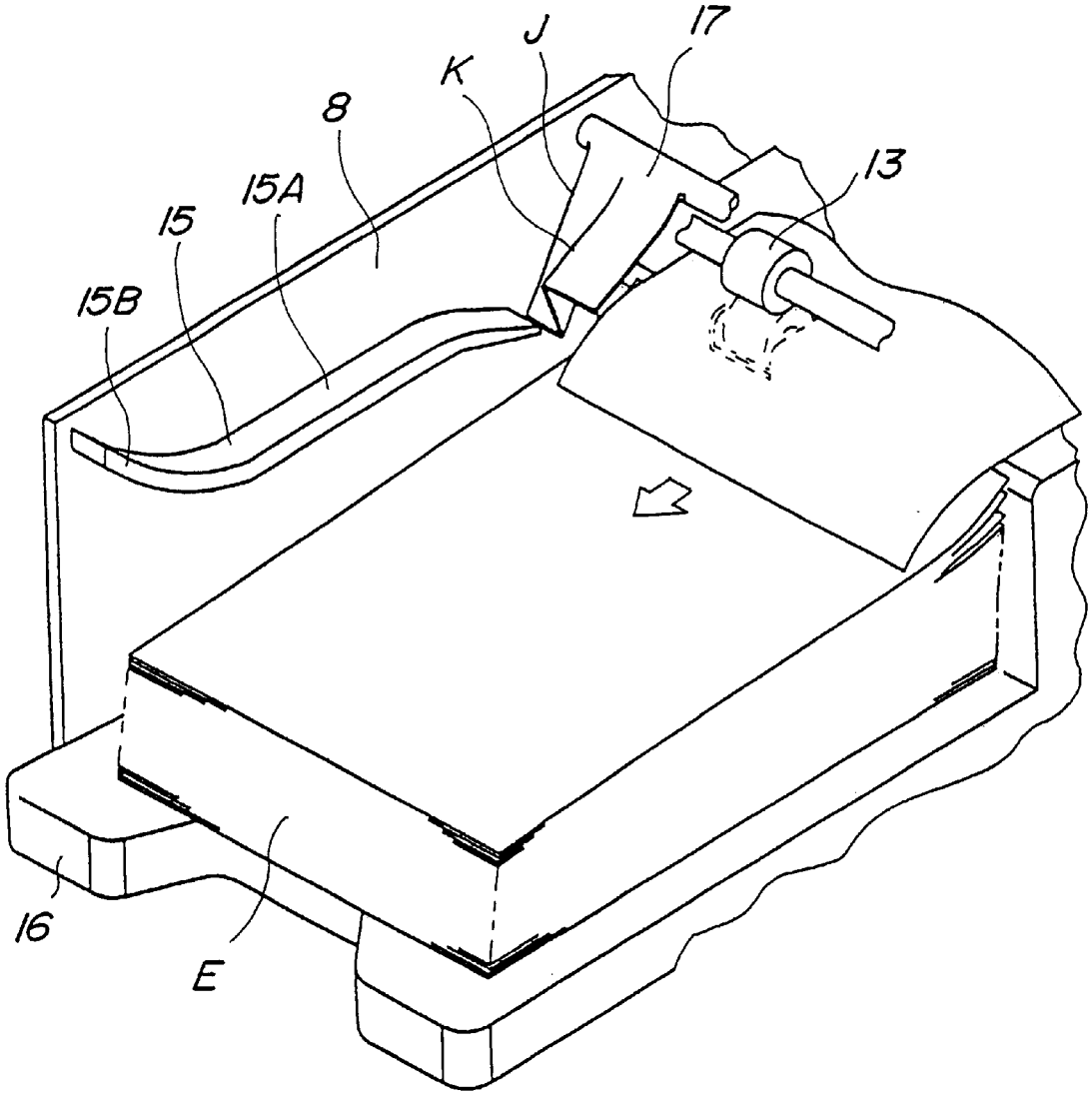
FIG. 11 is a typical perspective view showing a state of the fully-loaded detection means in the sheet stacking portion of the sheet processing apparatus.

As shown in FIG. 11, in the non-staple mode, the sheet delivered from the sheet alignment portion 4 by the delivery roller 13 is then stacked at an approximately center in the sheet width direction on the stacking tray 16 as mentioned above. The second detecting position K of the rear-end fully-loaded detection flag 17 is disposed in a position capable of detecting a height of the sheets stacked at the approximately center on the stacking tray 16, for detecting the fully-loaded condition before the height of the sheets stacked at the approximately center on the stacking tray 16 exceeds a nip position between the delivery roller 13 and the backup roller 14. In other words, since the sheets do not contact with the guide means 15 in the non-staple mode, substantially more sheets can be stacked on the stacking tray 16. Consequently, by setting the detecting position higher, an efficient process in the non-staple mode can be performed.

Figure 12:
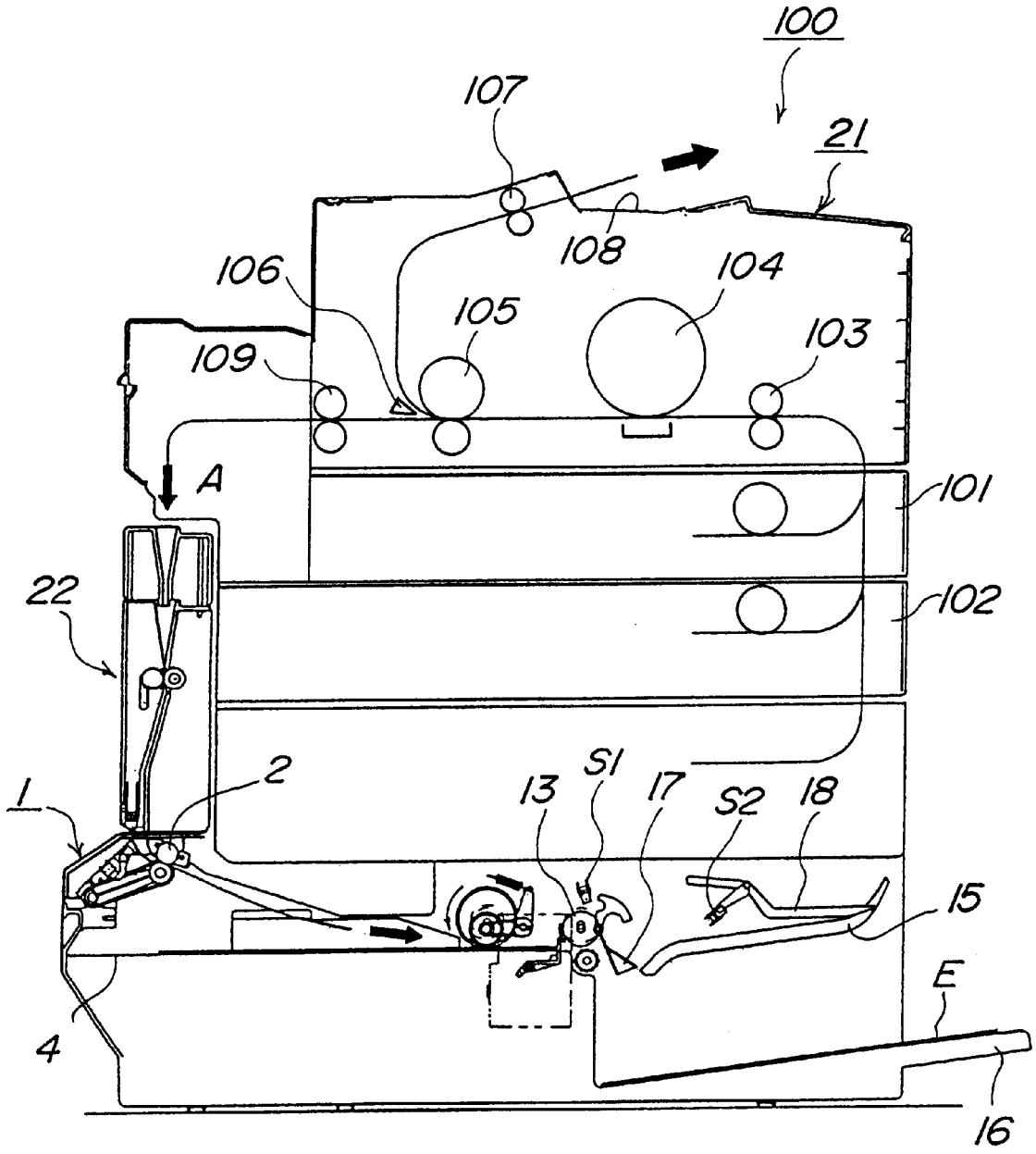
FIG. 12 is a typical cross section of an image forming apparatus having the sheet processing apparatus.

It is to be noted that an entire structure of a printer as an image forming apparatus mounting the aforementioned sheet processing apparatus is typically shown in FIG. 12.

In FIG. 12, numeral 21 refers to a main body of the printing apparatus 100. In this printing apparatus 100, a sheet is fed from one of cassettes 101, 102 to a photosensitive dram 104, as recording means, via a registration roller pair 103, wherein a recording image is formed thereon. After this recording process, the sheet is carried to fixing means 105 to fix the recorded image on the sheet. Then, in a case of non-sheet processing mode, a flapper 106 changes the position for directing the sheet to be delivered to a single sheet tray 108 via a delivery roller pair 107. In a case of sheet processing mode, a flapper 106 changes the position for directing the sheet to be delivered toward the sheet processing apparatus 1 via a carrying roller pair 109. The sheet delivered toward an arrow A from a rear surface of the main body 21 of the printing apparatus is conveyed via a vertical conveying portion 22 to the sheet processing apparatus 1. The sheet thus conveyed to the sheet processing apparatus 1 is then introduced by the alignment delivery roller 2 to the sheet alignment portion 4 where such a process as binding or the like is selectively performed.

As mentioned above, according to the present embodiment, the sheet bundle in a staple mode is to be delivered along the guide means 15 onto the sheet stacking tray 16, thus to be able to prevent the front end portion of the sheet bundle from hanging down. This can prevent occurrence of the poor stacking where the front end hanging down is caught by the staple portion of the sheet bundle already stacked on the sheet stacking tray 16 to push the sheet bundle out.

In addition, since the guide means 15 is formed along a delivery angle of the sheet bundle to be delivered on the sheet stacking tray 16 and has the straight shaped portion 15A for keeping the angle of sheet bundle at the delivery angle, in a staple mode, until the time that the final stapling process of the sheet bundle is completed, an upward floating of sheets between staples can be prevented with respect to a sheet bundle subjected to the plural-position binding operation in a staple mode.

Further, the guide means 15 has the R-shaped portion 15B on the downstream side in the sheet conveying direction of the straight shaped portion 15A for introducing the sheet bundle to an upper direction. Since the R-shaped portion 15B of the guide means 15 further has the slope 15*a* on the stacking portion side for dropping the guided sheet bundle onto the stacking portion, a stacking property of the sheet can be improved and the number of the stacking sheets can be increased, in terms of the front-end one-position binding operation in a staple mode.

Also, the sheet stacking portion is provided with the fully-loaded detection flags 17, 18 respectively at a front end and a rear end in the sheet conveying direction of the stacked sheet bundle, and the fully-loaded detection flags 17, 18 detect different fully-loaded heights at the front end and the rear end in the sheet conveying direction along the shape of the guide means 15. The front-end fully-loaded detection flag 18 for detecting the fully-loaded height of the front end of the sheet bundles in the conveying direction is a sensor for detecting the height by contacting with the sheet bundle, where detecting the fully-loaded condition can be made before the height of the stacked sheet bundles exceeds the height of the guide means 15.

The fully-loaded detection flag 17 for detecting the fully-loaded height of the rear end of the sheet bundle in the conveying direction has different fully-loaded detection heights between in the non-staple mode and in the staple mode in which, at least in the staple mode, detecting the fully-loaded height is carried out at the stapling guide position, and the fully-loaded detection flag 17 has also the plurally stepped shape capable of detecting the plural heights in the sheet width direction. Thus, the fully-loaded detections of the different heights in respective non-staple and staple modes can be made.

Second Embodiment

Figure 13:
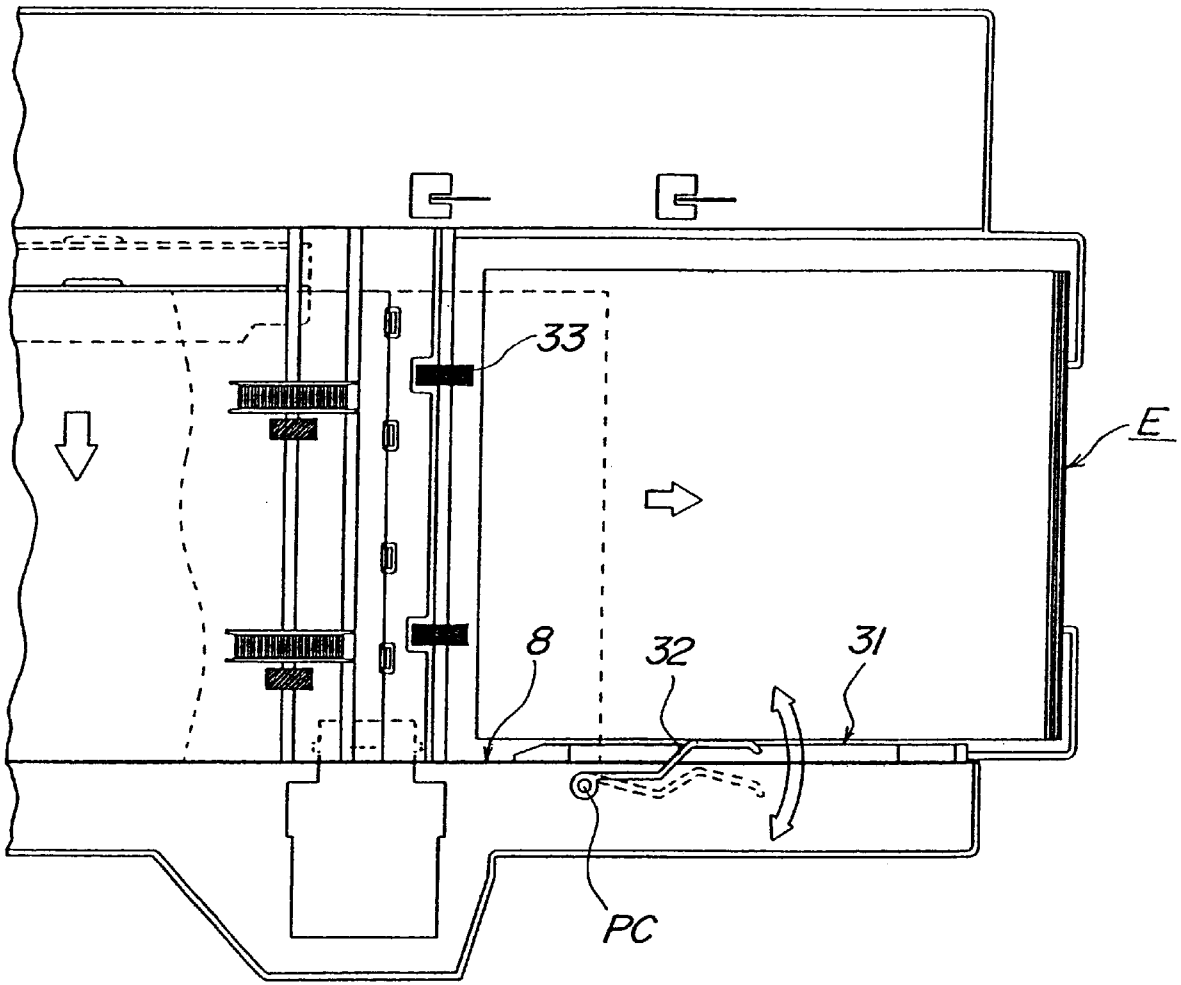
FIG. 13 is a structural view seen from a top surface of a sheet processing apparatus according to a second embodiment.

A sheet processing apparatus according to a second embodiment will be described in detail based on FIG. 13. FIG. 13 is a structural view seen from a top surface of the sheet processing apparatus according to the second embodiment.

In the present embodiment, a sheet bundle pushing means 32 capable of going in and out in an arrow direction in FIG. 13 by a drive means (not shown) such as a rotary plunger or the like is disposed above the guide means 15 formed on the reference wall 8. The sheet bundle pushing means 32, normally waiting in the reference wall 8, can push the sheet bundle E at a timing when a rear end of the sheet bundle E delivered to the stacking portion passes through the delivery roller 13.

With this arrangement, leaning of the stacked sheet bundle E on the guide means 31 can be eliminated and the number of the stacking sheets can be increased.

The pushing means 32 can be replaced with a spring means such as a leaf spring or the like. Also, the same advantages can be obtained when, instead of the pushing means 32, a portion of the reference wall 8 of itself is operated so as to push the sheet bundle.

Third Embodiment

Figure 14:
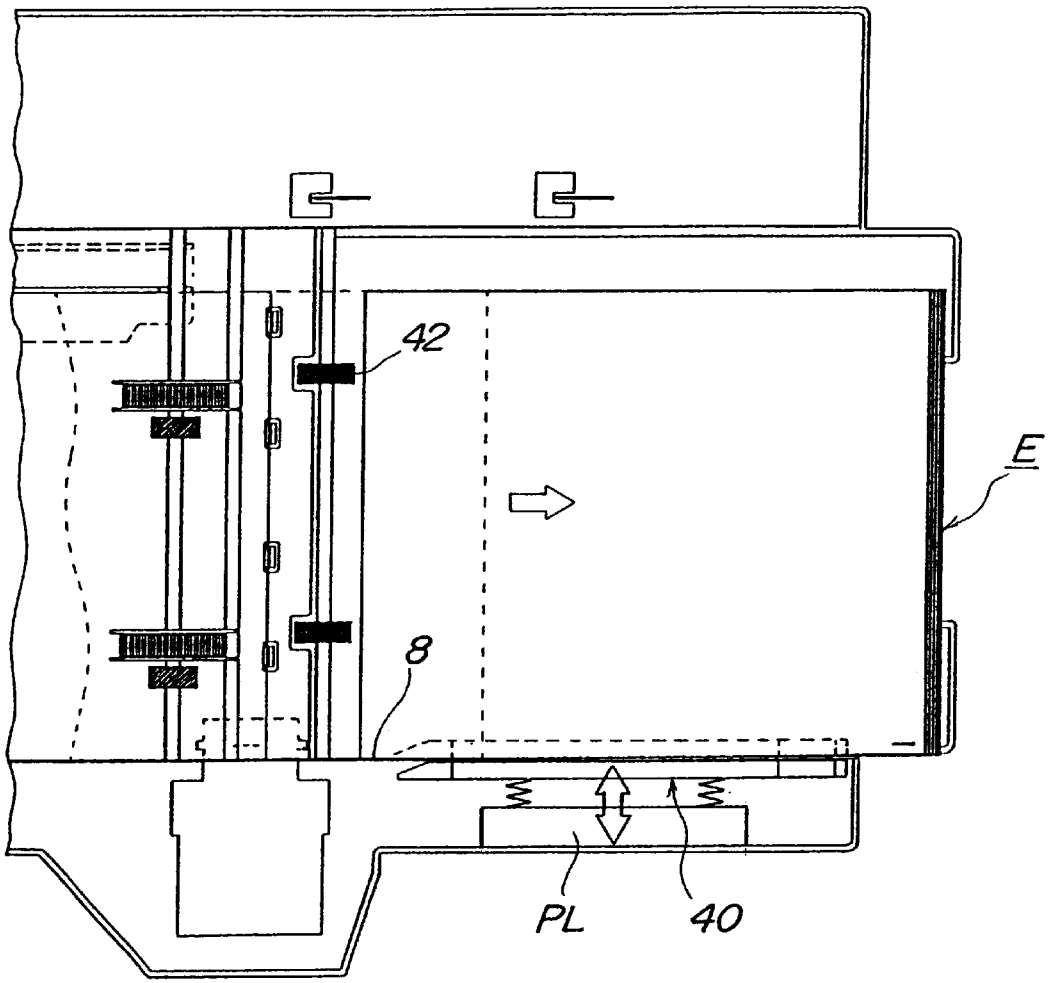
FIG. 14 is a structural view seen from a top surface of a sheet processing apparatus according to a third embodiment.

A sheet processing apparatus according to a third embodiment will be described in detail based on FIG. 14. FIG. 14 is a structural view seen from a top surface of the sheet processing apparatus according to the third embodiment.

A guide means 40 (with the same shape and function as the guide 15) according to the present embodiment is provided so as to be capable of going in and out, from the reference wall 8, in an arrow direction in FIG. 14 by a linear plunger means.

With this arrangement, the guide means 40 can be stored in the reference wall 8 at a timing when a rear end of the sheet bundle E delivered to the stacking portion passes through a rear end of the delivery roller 13, and therefore, leaning of the guided sheet bundle E on the guide means 40 can be eliminated and the number of stacking sheets can be increased.

Fourth Embodiment

Figure 15:
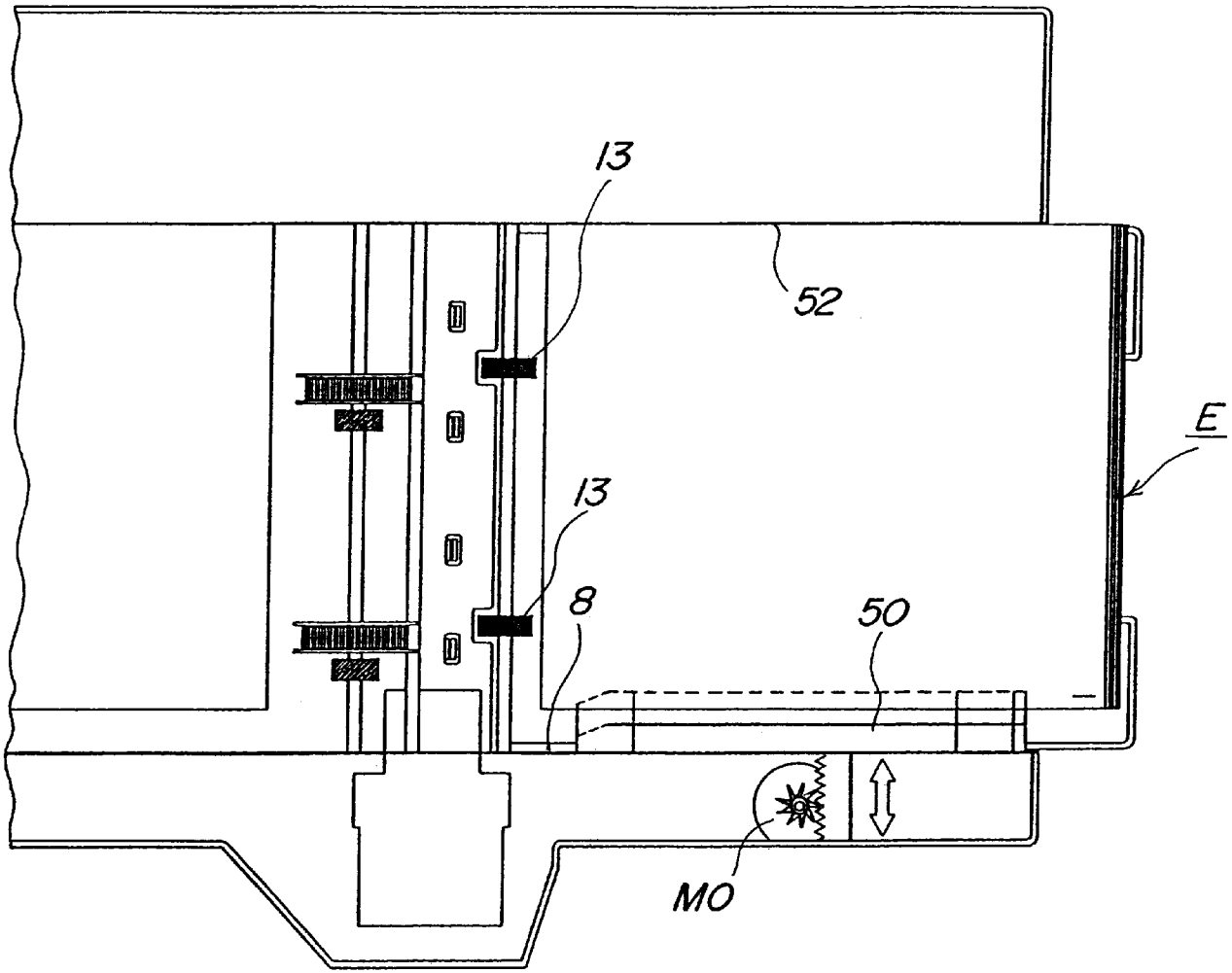
FIG. 15 is a structural view seen from a top surface of a sheet processing apparatus according to a fourth embodiment.

A sheet processing apparatus according to a fourth embodiment will be described in detail based on FIG. 15. FIG. 15 is a structural view seen from a top surface of the sheet processing apparatus according to the fourth embodiment.

A guide means 50 (with the same shape as that of the guide 15) has a drive means, such as a pinion and rack of a pulse motor, capable of adjusting a protruding amount from the reference wall 8 and a sensor means S for detecting a position of the delivered sheet bundle E, where the guide means 50 can move in and out in arrow directions in FIG. 15 in accordance with the sheet position.

With this arrangement, even such a sheet processing apparatus, as adjusting a sheet position with a wall 52 opposite to the reference wall 8 and as having a structure in which a distance between the sheet bundle E and the reference wall 8 varies due to sheet sizes, can guide the delivered sheet bundle E.

Fifth Embodiment

Figure 16:
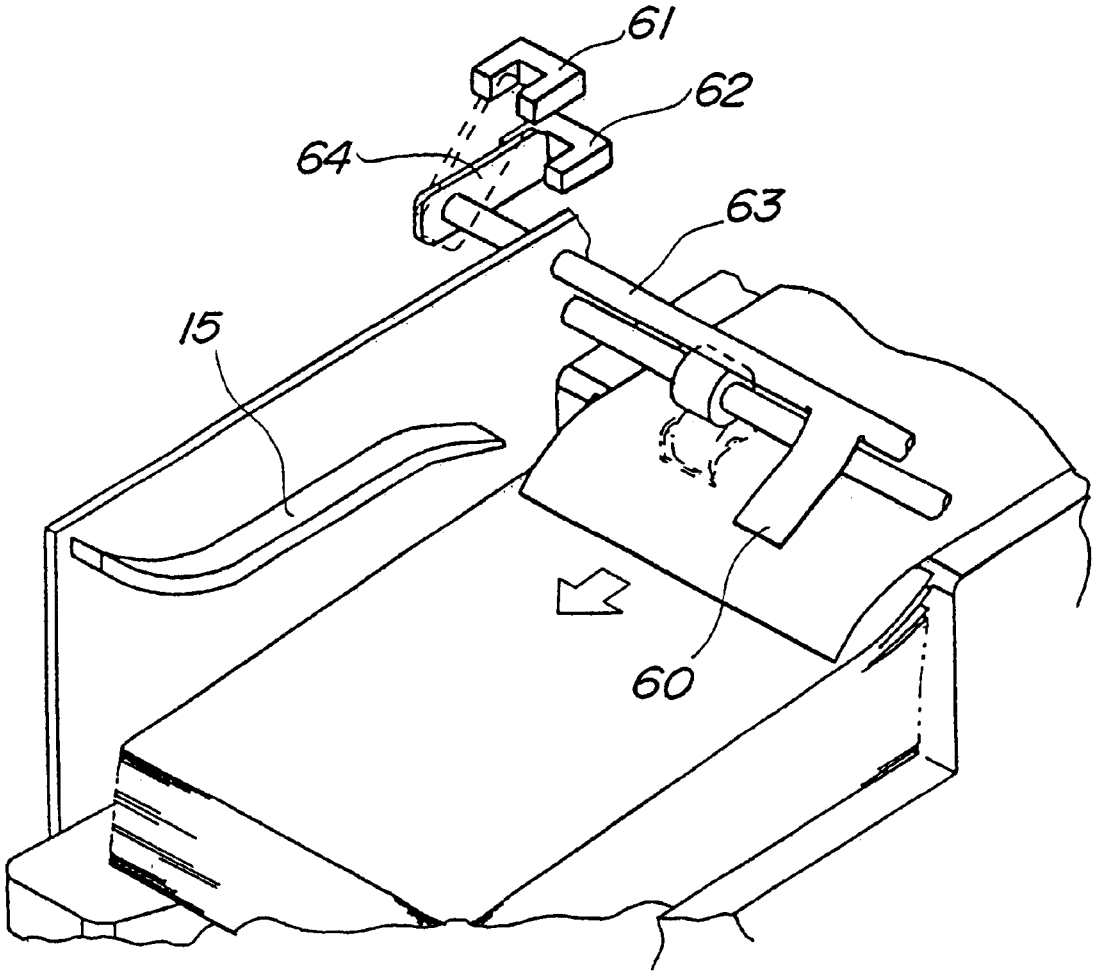
FIG. 16 is an explanation view of a fully-loaded detection means of a sheet processing apparatus according to a fifth embodiment.

A sheet processing apparatus according to a fifth embodiment will be described in detail based on FIG. 16. FIG. 16 is an explanation view of a fully-loaded detection means of the sheet processing apparatus according to the fifth embodiment.

The fully-loaded detection means according to the present embodiment is a detection means constituted of a fully-loaded detection flag 60, a first fully-loaded detection sensor 61, a second fully-loaded detection sensor 62 and a stacking mode (not shown). More specifically, the fully-loaded detection flag 60 is attached to a rotary rod 63 having the other end attached to an arm 64, and a situation can be understood depending on which sensor, the first fully-loaded detection sensor 61 or the second fully-loaded detection sensor 62, detects the arm 64.

In structures of the guide means and the reference wall as in the fourth embodiment, the fully-loaded detection flag having plural detection heights as in the present invention may not correspond with the fully-loaded detection in each mode. Thus, in the present embodiment, the present stacking mode is first detected and then a predetermined sensor is selected from the plural fully-loaded detection sensors 61, 62 so that a detection corresponding to each mode is to be carried out.

With this arrangement, the same advantages can be obtained, without providing a plurality of detecting positions by making the shape of the fully-loaded detection flag stepped as in the first embodiment.

Furthermore, when the fully-loaded detection sensor is made movable in a width direction of the sheet, the fully-loaded detection under various conditions can be performed by change of the detecting positions in accordance with a selected mode or a selected sheet size.

Other Embodiments

In the above embodiments, a printer as an image forming apparatus is used by way of example, but the present invention is not limited to this; for example, other image forming apparatus such as a copying machine, a facsimile machine or the like may be used, and the same advantages can be obtained by applying the present invention to a sheet processing apparatus used in the image forming apparatus.

In the above embodiments, a sheet processing apparatus formed approximately integrally with the image forming apparatus is used by way of example, but the present invention is not limited to this; for example, a sheet processing apparatus detachable from an image forming apparatus may be used, and the same advantages can be obtained by applying the present invention to the sheet processing apparatus.

In the above embodiments, an electrophotographic method as a recording method is used by way of example, but the present invention is not limited to this; for example, other recording method such as an ink jet method or the like may be used.

What is claimed is:

1. A sheet processing apparatus comprising:

an intermediate stacking portion for aligning a sheet sent;

a reference wall, disposed on one side in a width direction intersecting a conveying direction of the sheet, for serving as a reference for positioning the sheet;

a stapler for performing a binding operation on one side in the width direction of the sheet with respect to a sheet bundle aligned by the reference wall;

delivery means for delivering the sheet bundle from the intermediate stacking portion;

a sheet stacking portion for stacking the sheet bundle delivered from the delivery means; and guide means provided above the sheet stacking portion and at an end portion on the stapler side of the end portions in the width direction of the sheet, wherein the guide means supports an end portion on the stapler side of the sheet bundle when the sheet bundle is delivered from the delivery means in a staple mode in which the binding operation is performed with respect to the sheet bundled.

2. The sheet processing apparatus according to claim 1, wherein a delivered position of the sheet bundle in the width direction of the sheet varies respectively between in the staple mode in which the binding operation is performed with respect to the sheet bundle and in a non-staple mode in which no binding operation is performed.

3. The sheet processing apparatus according to claim 1, wherein the guide means has a straight shaped portion, and wherein the straight shaped portion has an angle set at substantially the same angle as a delivery angle of the sheet bundle.

4. The sheet processing apparatus according to claim 1, wherein the guide means has an R-shaped portion which is connected from the straight portion and is curving upwardly.

5. The sheet processing apparatus according to claim 4, wherein the R-shaped portion of the guide means has a slope inclining downwardly toward the other side of the sheet so as to drop the guided sheet bundle onto the sheet stacking portion.

6. The sheet processing apparatus according to claim 1, wherein the sheet stacking portion includes front-end fully-loaded detection means for detecting a fully-loaded state of front ends of the sheet bundles.

7. The sheet processing apparatus according to claim 6, wherein the sheet stacking portion further includes rear-end fully-loaded detection means for detecting a fully-loaded state at a rear end of the sheet bundle, and wherein the front-end filly-loaded detection means and the rear-end fully-loaded detection means detect respectively different heights.

8. The sheet processing apparatus according to claim 1, wherein the sheet stacking portion includes rear-end fully-loaded detection means for detecting a fully-loaded state at a rear end of the sheet bundle.

9. The sheet processing apparatus according to claim 8, wherein a delivered position of the sheet bundle in the width direction of the sheet varies respectively between in the staple mode in which a binding operation is performed with respect to the sheet bundle and in a non-staple mode in which no binding operation is performed, and wherein the rear-end fully-loaded detection means detects stacking heights different between the delivered position in the staple mode and the delivered position in the non-staple mode.

10. The sheet processing apparatus according to claim 9, wherein the rear-end fully-loaded detection means is a contact sensor having a lower first detecting position in contact with the sheet bundle in the staple mode and a higher second detecting portion in contact with the sheet in non-staple mode.

11. The sheet processing apparatus according to claim 1, wherein, on a top surface side of the guide means, pushing means is provided moving forward and backward in a width direction of the guide means, and wherein moving forward of the pushing means eliminates the sheet bundle from the guide means.

12. The sheet processing apparatus according to claim 1, wherein the guide means moves forward and backward from a wall surface to which the guide means is attached, and wherein moving backward of the guide means eliminates the sheet bundle from the guide means.

13. An image forming apparatus comprising:

image forming means for forming an image on a sheet;

conveying means for conveying the sheet where the image is formed; and a sheet processing apparatus according to either claim 1 or claim 12 for processing the sheet thus conveyed.

14. The sheet processing apparatus according to claim 2, wherein, in the non-staple mode, the sheet is stacked on the sheet stacking portion without being aligned in the intermediate stacking portion.

15. The sheet processing apparatus according to claim 14, wherein the delivery means is a detachable pair of rollers which are normally separated, and the sheet bundle is delivered by closing of the pair of rollers.

16. The sheet processing apparatus according to claim 15, wherein the pair of rollers is closed in the non-staple mode, where the sheet entering into the intermediate stacking portion is sequentially delivered sheet by sheet.

* * * * *

UNITED STATES PATENT AND TRADEMARK OFFICE

CERTIFICATE OF CORRECTION

PATENT NO. : 6,382,614 B1
DATED : May 7, 2002
INVENTOR(S) : Masayoshi Fukatsu et al.

It is certified that error appears in the above-identified patent and that said Letters Patent is hereby corrected as shown below:

Title page,
Item [57], ABSTRACT,
Line 4, "form" should read -- for --.
Item [30], Foreign Application Priority Data, "Jul. 30, 1999 (JP) …… 11-216050" should be deleted.
Item [56], References Cited, FOREIGN PATENT DOCUMENTS,
"JP A-03-004386 1/1991, JP A-05-324902 12/19993, "JP A-08-212298 8/1996, "JP A-11-025213 1/1999, "JP A-11-025217 1/1999" should be deleted.

Column 1,
Line 40, "conveyed" should read -- be conveyed --.

Column 4,
Line 38, "an" should read -- a --.

Column 8,
Line 32, "dram 104," should read -- drum 104, --.

Column 12,
Line 30, "portion" should read -- position --.
Line 49, "either claim 1 or" should read -- any one of claim 1 to --.
Line 61, "sheet" should read -- sheets --.

Signed and Sealed this

Twelfth Day of November, 2002

*Attest:*

*Attesting Officer*

JAMES E. ROGAN
*Director of the United States Patent and Trademark Office*